United States Patent [19]

Kobayashi et al.

[11] Patent Number: 4,625,699

[45] Date of Patent: Dec. 2, 1986

[54] METHOD AND APPARATUS FOR CONTROLLING AIR-FUEL RATIO IN INTERNAL COMBUSTION ENGINE

[75] Inventors: Nobuyuki Kobayashi; Takashi Hattori, both of Toyota, Japan

[73] Assignee: Toyota Jidosha Kabushiki Kaisha, Toyota, Japan

[21] Appl. No.: 760,658

[22] Filed: Jul. 30, 1985

[30] Foreign Application Priority Data

Aug. 3, 1984 [JP] Japan ..... 59-163497

[51] Int. Cl.[4] ..... F02D 41/14

[52] U.S. Cl. ..... 123/489; 123/440

[58] Field of Search ..... 123/440, 480, 489, 520

[56] References Cited

U.S. PATENT DOCUMENTS 4,413,601 11/1983 Matsuoka et al. ..... 123/486 X
4,461,261 7/1984 Isomura et al. ..... 123/486 X
4,467,769 8/1984 Matsumura ..... 123/520 X
4,517,949 5/1985 Ito et al. ..... 123/489

FOREIGN PATENT DOCUMENTS 53184 11/1983 Japan .

*Primary Examiner*—Tony M. Argenbright
*Attorney, Agent, or Firm*—Kenyon & Kenyon

[57] ABSTRACT

In an internal combustion engine wherein a learning correction amount for improving the drivability in a high altitude is introduced into the feedback control of the air-fuel ratio, a lower limit is imposed on the learning correction amount, and a reference value for the lower limit is renewed in accordance with comparison of the mean value of an air-fuel ratio correction amount with a predetermined value and comparison of the learning correction amount with the reference value in an idling state.

10 Claims, 25 Drawing Figures

Vox
1V
0
$V_R$

"1"
"0"
LEAN
RICH

FAF
$SKP_1$
$KI_1$
$KI_2$
$SKP_2$

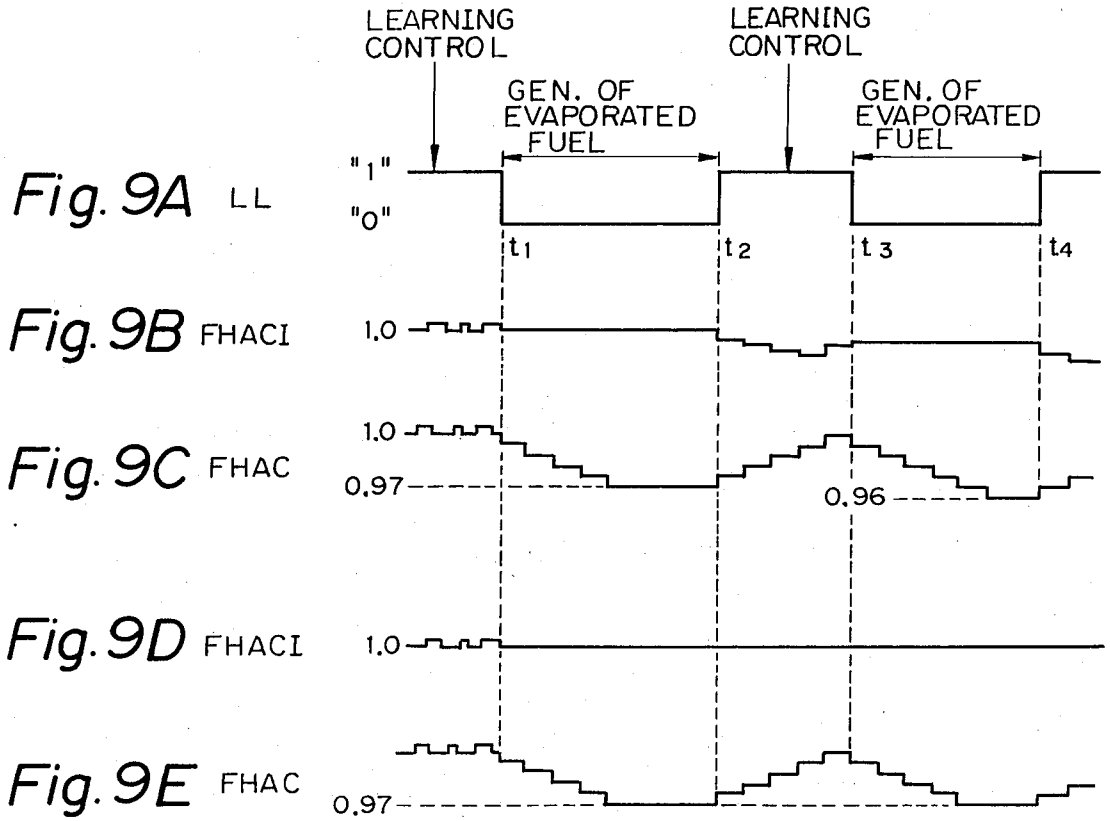
Fig. 9A LL
Fig. 9B FHACI
Fig. 9C FHAC
Fig. 9D FHACI
Fig. 9E FHAC

| |
|---|
| Fig. 10A |
| Fig. 10B |

LEARNING CONTROL ROUTINE II
1101
Q ?
Q1
Q2
Q3
Q4
Q5
Q6
1102
0.98≦ FAFAV2 ≦1.02 ?
YES
NO
1103
FGQ1 ← FGQ1 + GKD
FAFAV2 ← FAFAV2+0.002
1104
FGQ1 > 0.10 ?
YES
NO
1105
FGQ1 ← 0.10
1122
FAFAV1 > 1.0 ?
YES
NO
1123
FGQ2 ← FGQ2+0.002
FGQ3 ← FGQ3+0.001
FGQ4 ← FGQ4+0.001
FGQ5 ← FGQ5+0.001
FGQ6 ← FGQ6+0.001
FHAC ← FHAC+0.004
1124
FGQ2 ← FGQ2−0.002
FGQ3 ← FGQ3−0.001
FGQ4 ← FGQ4−0.001
FGQ5 ← FGQ5−0.001
FGQ6 ← FGQ6−0.001
FHAC ← FHAC−0.004

METHOD AND APPARATUS FOR CONTROLLING AIR-FUEL RATIO IN INTERNAL COMBUSTION ENGINE

BACKGROUND OF THE INVENTION (1) Field of the Invention

The present invention relates to a method and apparatus for feedback control of the air-fuel ratio in an internal combustion engine.

(2) Description of the Related Art

Generally, in a feedback control of the air-fuel ratio, a base fuel amount TAUP is calculated in accordance with the detected intake air amount and the detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three way reducing and oxidizing catalysts which can remove three pollutants CO, HC, and $NO_x$ simultaneously from the exhaust gas.

The above-mentioned fuel correction coefficient FAF is affected by the characteristics of the parts of the engine, the environmental changes, and the like. That is, the center of the fuel correction coefficient FAF often deviates from an optimum value such as 1.0 as a result of the individual differences in the characteristics of the parts of the engine such as the air-fuel ratio sensor, the fuel injection valves, the airflow meter (or the pressure sensor), etc., or individual changes due to the aging thereof. Further, the center of the air-fuel correction coefficient FAF deviates from an optimum value when driving at a high altitude. As a result, the difference between the air-fuel ratio correction coefficient FAF during an air-fuel ratio feedback control (closed-loop control) and the air-fuel ratio correction coefficient FAF during a non air-fuel ratio feedback control (open loop control) is large, so that the change of the controlled air-fuel ratio in a transient state between the closed loop control and the open loop control or vice versa is large. Note that the air-fuel ratio correction coefficient FAF during an open loop control is made to be an optimum value such as 1.0.

In order to compensate for the change of the center of the air-fuel correction coefficient FAF due to the individual differences in the characteristics of the parts of the engine, individual changes thereof due to aging, and driving at a high altitude, another air-fuel ratio correction coefficient, called a learning correction coefficient FG, is introduced to maintain an optimum air-fuel ratio. In this case, the base fuel amount TAUP is corrected by two coefficients, i.e., FAF and FG, to obtain a final fuel amount TAU by $$TAU = TAUP \cdot FAF \cdot FG \cdot \alpha + \beta$$

where $\alpha$ and $\beta$ are determined by other engine parameters.

In a learning control for calculating the learning correction coefficient FG, it is necessary to consider that vaporized fuel stocked in a canister may be supplied to a combustion chamber under a predetermined condition, thereby temporarily making the air-fuel ratio to be on the rich side. For example, as shown in FIG. 1, which shows the base air-fuel ratio characteristics due to the vaporized fuel from the canister, when the intake air amount Q is within a special range around 100 $m^3/h$, the base air-fuel ratio deviates by 10% from the stoichiometric air-fuel ratio ($\lambda = 1$). Therefore, if the engine is stopped immediately after learning control is carried out for the change of the air-fuel ratio correction amount FAF due to the vaporized fuel from the canister, the air-fuel ratio becomes on the leaner side when the engine restarts. As a result, misfires may be invited to reduce the drivability.

Thus, it is not preferable to perform learning control upon the rich air-fuel ratio due to the vaporized fuel from the canister.

On the other hand, when driving at a high altitude, the density of air becomes small, so that air-fuel feedback control decreases the air-fuel ratio correction coefficient FAF. Therefore, in order to increase the air-fuel ratio correction coefficient FAF, learning control is carried out to decrease the learning correction coefficient FG. As shown in FIG. 2, which shows the base air-fuel ratio characteristics due to the driving at a high altitude, the base air-fuel ratio is at a definite rich value regardless of the intake air amount Q.

In view of the foregoing, it is necessary to discriminate the rich base air-fuel ratio due to the vaporized fuel of the canister from the rich base air-fuel ratio due to the driving at a high altitude.

In FIGS. 1 and 2, note that LL="1" means an idling state of the engine, which will be later explained.

SUMMARY OF THE INVENTION

It is an object of the present invention to provide a method and apparatus for controlling the air-fuel ratio in an internal combustion engine in which learning control is carried out by discriminating the base rich air-fuel ratio due to the vaporized fuel of the canister from the base rich air-fuel ratio due to driving at a high altitude.

According to the present invention, a lower limit FHACI imposed on the learning correction coefficient FG(FHAC) is renewed in accordance with the learning correction coefficient FHAC under predetermined conditions in an idling state. That is, when in an idling state, the mean value FAFAV1 of the air-fuel ratio correction coefficient FAF is compared with a predetermined value (an optimum air-fuel ratio) such as 1.0, and the learning correction coefficient FHAC is compared with a lower limit reference value FHACI for the lower limit. As a result, when the mean value FAFAV1 is larger than the predetermined value, and in addition, the learning correction coefficient FHAC is larger then the lower limit reference value FHACI, the lower limit reference FHACI is renewed.

Thus, even when the throttle valve is not completely closed to supply vaporized fuel from the canister to the combustion chambers, thereby enriching the base air-fuel ratio, the learning coefficient is guarded by the lower limit which is renewed in an idling state. In addition, even when the throttle valve is frequently opened and closed, the lower limit reference value FHACI is not renewed, i.e., the lower limit is not renewed. Therefore, the learning correction coefficient FHAC recovers promptly from the affect of vaporized fuel from the canister.

BRIEF DESCRIPTION OF THE DRAWINGS

The present invention will be more clearly understood from the description as set forth below with reference to the acccompanying drawings, wherein:

FIGS. 9A through 9E are timing diagrams explaining the flow charts of FIGS. 6 and 7.

DESCRIPTION OF THE PREFERRED EMBODIMENTS

Figure 1:
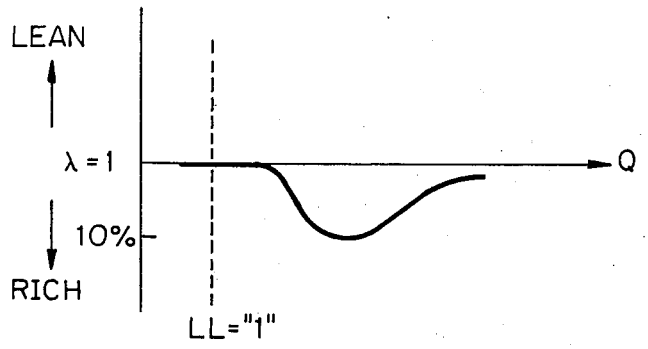
FIG. 1 is a graph showing the base air-fuel ratio due to the vaporized fuel from the canister.
Figure 2:
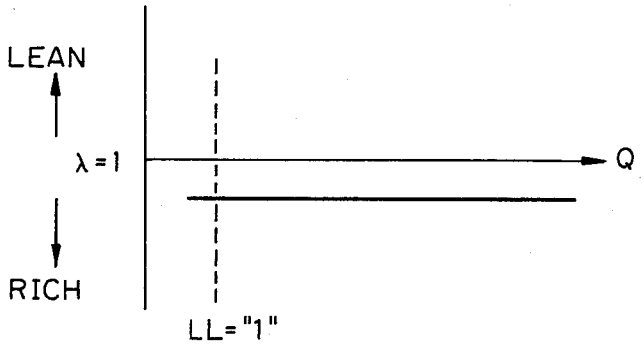
FIG. 2 is a graph showing the base air-fuel ratio due to driving at a high altitude.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Also provided in the air-intake passage 2 is a throttle valve 4 which has an idling position switch 5 at the shaft thereof. The idling position switch 5 detects whether or not the throttle valve 4 is completely closed, i.e., in an idling position, to generate an idle signal "LL" which is transmitted to an input/output (I/O) interface 102.

Reference numeral 6 designates an active carbon canister linked to a fuel tank 7. Vaporized fuel in the fuel tank 7 is adhered to the active carbon canister 6. The canister 6 is also linked to a purge port 8 and a purge air intake port 9 which are located upstream of the throttle valve 4. Therefore, after vaporized fuel is adhered to the canister 6 in an idling state, the vaporized fuel is supplied via the purge port 8 to the combustion chambers of the engine 1 when the throttle valve 4 is opened at an angle larger than 12 to 13 degrees.

Disposed in a distributor 11 are crank angle sensors 12 and 13 for detecting the angle of the crankshaft (not shown) of the engine 1. In this case, the crank-angle sensor 12 generates a pulse signal at every 720° crank angle (CA) while the crank-angle sensor 13 generates a pulse signal at every 30° CA. The pulse signals of the crank angle sensors 12 and 13 are supplied to an input/output (I/O) interface 102 of the control circuit 10. In addition, the pulse signal of the crank angle sensor 13 is then supplied to an interruption terminal of a central processing unit (CPU) 103.

Additionally provided in the air-intake passage 2 is a fuel injection valve 14 for supplying pressurized fuel from the fuel system to the air-intake port of the cylinder of the engine 1. In this case, other fuel injection valves are also provided for other cylinders, though not shown in FIG. 1.

Disposed in a cylinder block 15 of the engine 1 is a coolant temperature sensor 16 for detecting the temperature of the coolant. The coolant temperature sensor 16 generates an analog voltage signal in response to the temperature of the coolant and transmits it to the A/D converter 101 of the control circuit 10.

Provided in an exhaust gas passage 17 of the engine 1 is a three-way reducing and oxidizing catalyst converter 18 which removes three pollutants CO, HC, and $NO_x$ simultaneously in the exhaust gas. Also provided upstream of the three way converter 18 is an $O_2$ sensor 19 for detecting the concentration of oxygen composition in the exhaust gas. The $O_2$ sensor 19 generates an output voltage signal and transmits it to the A/D converter 101 of the control circuit 10.

Reference numeral 20 designates a vehicle speed sensor which generates a pulse signal having a frequency in proportion to the vehicle speed SPD. The pulse signal is transmitted via a vehicle speed generating circuit 111 of the control circuit 10 to the I/O interface 102 thereof.

The control circuit 10, which may be constructed by a microcomputer, further comprises a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 14. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 14. On the other hand, the down counter 108 counts up the clock signal from the clock generator 107, and finally generates a logic "1" signal from the carry-out terminal thereof, to reset the flip-flop 109, so that the driver circuit 110 stops the activation of the fuel injection valve 14. Thus, the amount of fuel corresponding to the fuel injection amount TAU is injected into the fuel injection valve 14.

Interruptions occur at the CPU 103, when the A/D converter 101 completes an A/D conversion and generates an interrupt signal; when the crank angle sensor 13 generates a pulse signal; and when the clock generator 109 generates a special clock signal.

The intake air amount data Q of the airflow meter 3 and the coolant temperature data THW are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 13, and is then stored in the RAM 105.

Figure 3:
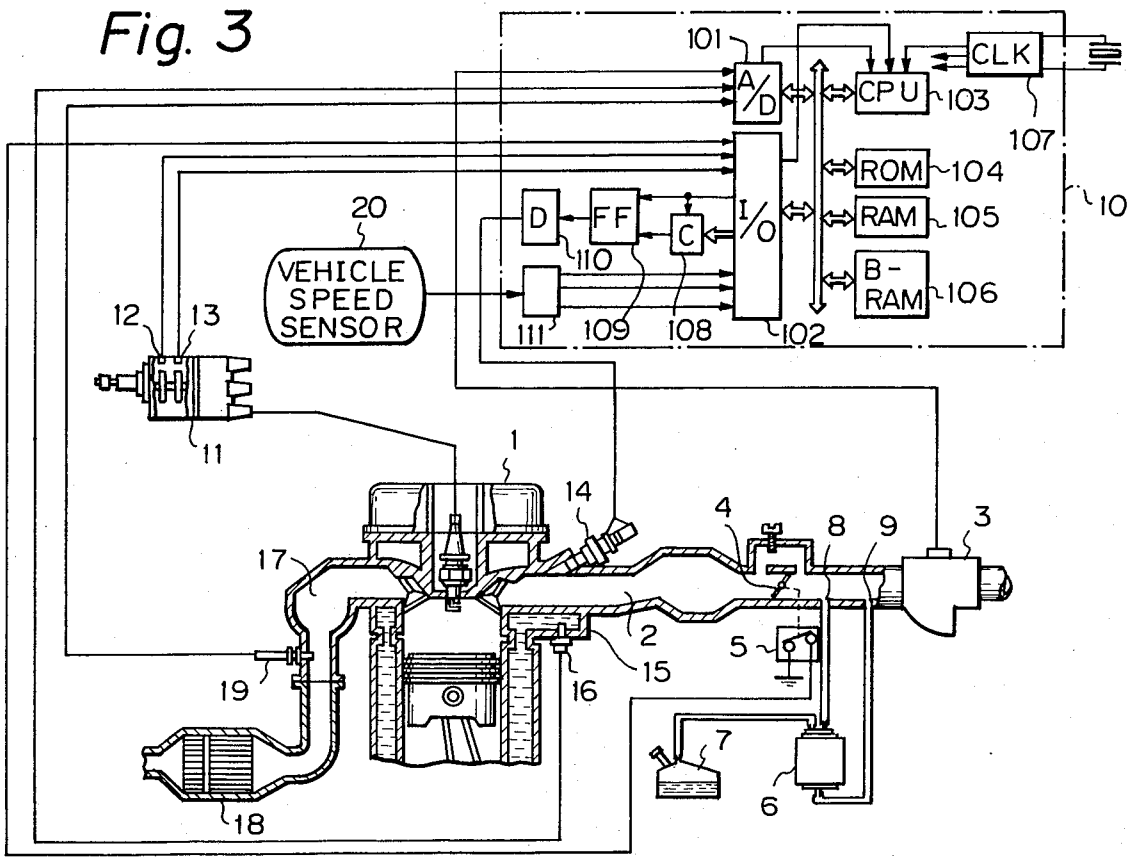
FIG. 3 is a schematic diagram of an internal combustion engine according to the present invention.

The operation of the control circuit 10 of FIG. 3 will be explained with reference to the flow charts of FIGS. 4, 6, 7, 8, 10, 11, and 12.

Figure 4:
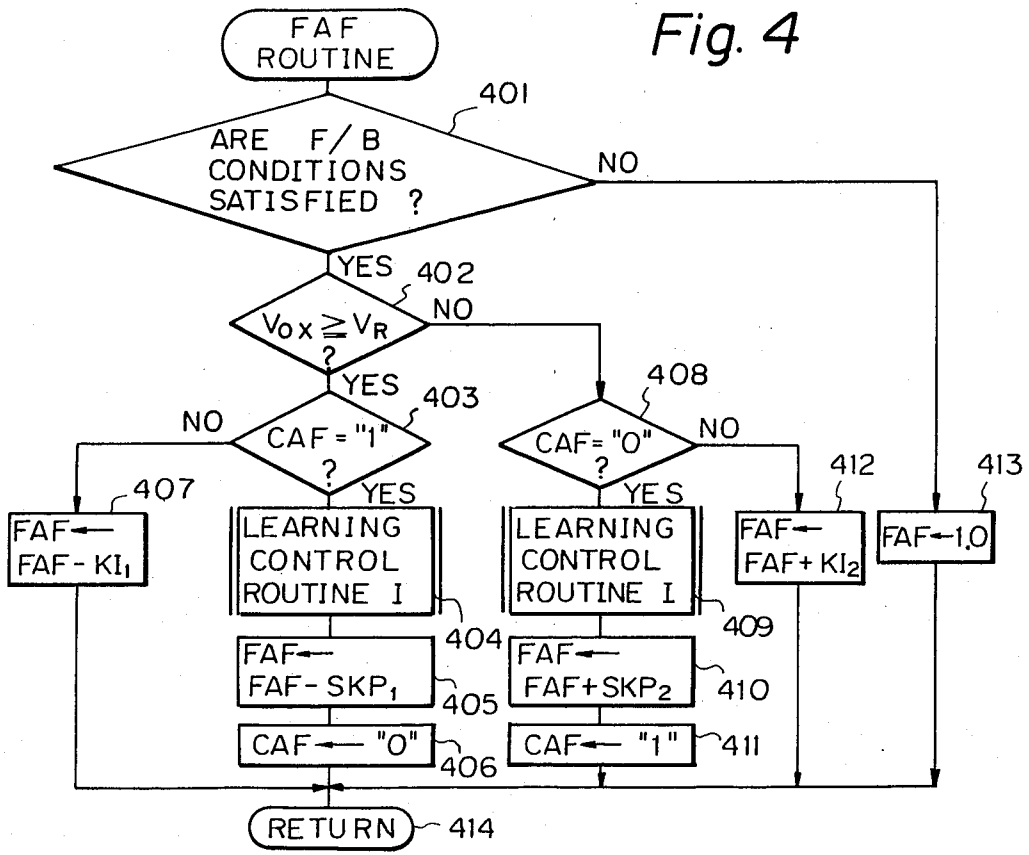
FIGS. 4, 6, 7, 8, 10, 10A, 10B, 11, 11A, 11B, 11C, 11D, and 13 are flow charts showing the operation of the control circuit of FIG. 1.

FIG. 4 is a routine for calculating an air-fuel ratio feedback correction coefficient FAF executed at every predetermined time period.

At step 401, it is determined whether or not all the feedback control (closed-loop control) conditions are satisfied. The feedback control conditions are as follows:

(i) the engine is not in a starting state;

(ii) the coolant temperature THW is higher than 50° C.; and (iii) the power fuel increment FPOWER is 0.

Of course, other feedback control conditions are introduced as occasion demands. However, an explanation of such other feedback control conditions is omitted.

If one or more of the feedback control conditions is not satisfied, the control proceeds to step 413, in which the coefficient FAF is caused to be 1.0 (FAF=1.0), thereby carrying out an open-loop control operation. Contrary to this, if all the feedback control conditions are satisfied, the control proceeds to step 402.

At step 402, an A/D conversion is performed upon the output signal $V_{OX}$ of the $O_2$ sensor 19, and the voltage $V_{OX}$ is compared with a reference voltage $V_R$ such as 0.4 V, thereby determining whether the current air-fuel ratio is on the rich side or on the lean side with respect to the stoichiometric air-fuel ratio. If $V_{OX} \geqq V_R$ so that the current air-fuel ratio is rich, the control proceeds to step 403 which determines whether or not a skip flag CAF is "1".

Note that the value "1" of the skip flag CAF is used for a skip operation when a first change from the rich side to the lean side occurs in the controlled air-fuel ratio, while the value "0" is used for a skip operation when a first change from the lean side to the rich side occurs in the controlled air-fuel ratio.

As a result, if the skip flag CAF is "1", the control proceeds to step 404, in which a learning control operation I is carried out. This learning control operation I will be explained later with reference to FIG. 6. The control further proceeds to step 405 which decreases the coefficient FAF by a relatively large amount $SKP_1$. Then, at step 406, the skip flag CAF is cleared, i.e. CAF←"0". Thus, when the control at step 403 is further carried out, the control proceeds to step 407, which decreases the coefficient FAF by a relatively small amount $K_1$. Here, $SKP_1$ is a constant for a skip operation which remarkably increases the coefficient FAF when a first change from the lean side ($V_{OX<VR}$) to the rich side ($V_{OX} \geqq V_R$) occurs in the controlled air-fuel ratio, while $KI_1$ is a constant for an integration operation which gradually decreases the coefficient FAF when the controlled air-fuel ratio is rich.

On the other hand, at step 402, if $V_{OX<VR}$ so that the current air-fuel ratio is lean, the control proceeds to step 408, which determines whether or not the skip flag CAF is "0". As a result, if the slip flag CAF is "0", the control proceeds to step 409 which carries out the same learning control operation as that of step 404. The control further proceeds to step 410 which increases the coefficient FAF by a relatively large amount $SKP_2$. Then, at step 611, the skip flag CAF is set, i.e., CAF←"1". Thus, when the control at step 408 is further carried out, the control proceeds to step 412, which increases the coefficient FAF by a relatively small amount $KI_2$. Here, $SKP_2$ is a constant for a skip operation which remarkably increases the coefficient FAF when a first change from the rich side ($V_{OX} \geqq V_R$) to the lean side ($V_{OX}<VR$) occurs in the controlled air-fuel ratio, while $KI_2$ is a constant for an integration operation which gradually increases the coefficient FAF when the controlled air-fuel ratio is lean.

The air-fuel ratio correction coefficient FAF obtained at step 405, 407, 410, 412, or 413 is stored in th RAM 485, and the routine of FIG. 4 is completed by step 414.

Figures 5A, 5B, 5C:
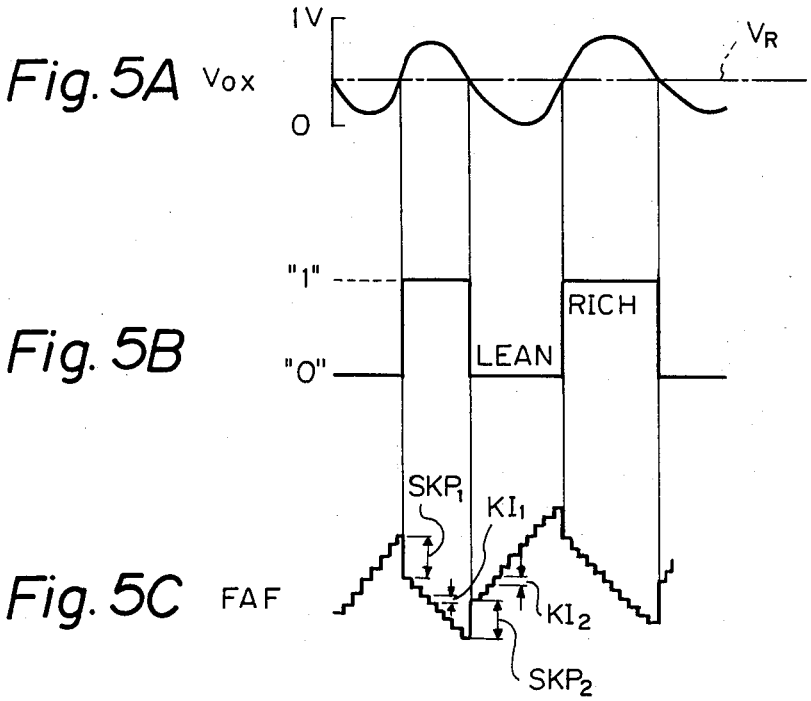
FIGS. 5A, 5B, and 5C are timing diagrams explaining the flow charts of FIG. 4.

FIGS. 5A, 5B, and 5C are timing diagrams for explaining the air-fuel correction coefficient FAF obtained by the routine of FIG. 4. That is, when the output voltage $V_{OX}$ of the $O_2$ sensor 19 is changed as shown in FIG. 5A, the comparison result at step 402 of FIG. 4 changes as shown in FIG. 5B. Referring to FIG. 5C, at every change of the air-fuel ratio from the rich side to the lean side, or vice versa, a skip amount $SKP_1$ is subtracted from the coefficient FAF, or a skip amount $SKP_2$ is added thereto. Conversely, when the air-fuel ratio remains on the rich side or on the lean side, an integration amount $KI_1$ is subtracted from the coefficient FAF, or an integration amount $KI_2$ is added thereto.

According to an aspect of the present invention, a learning correction coefficient FG is defined by $$FG=1+FHAC+DFC/Q$$

where FHAC is a learning correction coefficient for compensating the driving at a high altitude;

DFC is a learning correction coefficient for compensating the choking of the airflow meter; and Q is the intake air amount.

Figure 6:
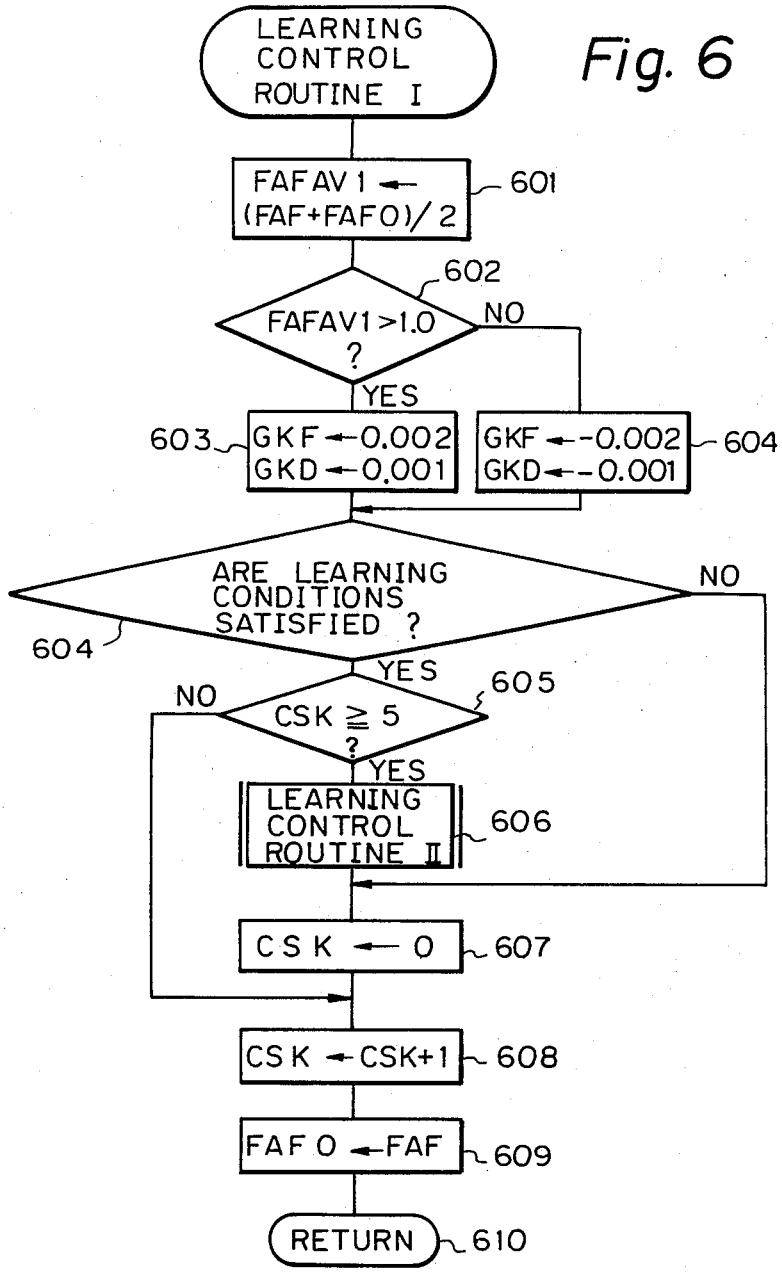
Figure 7:
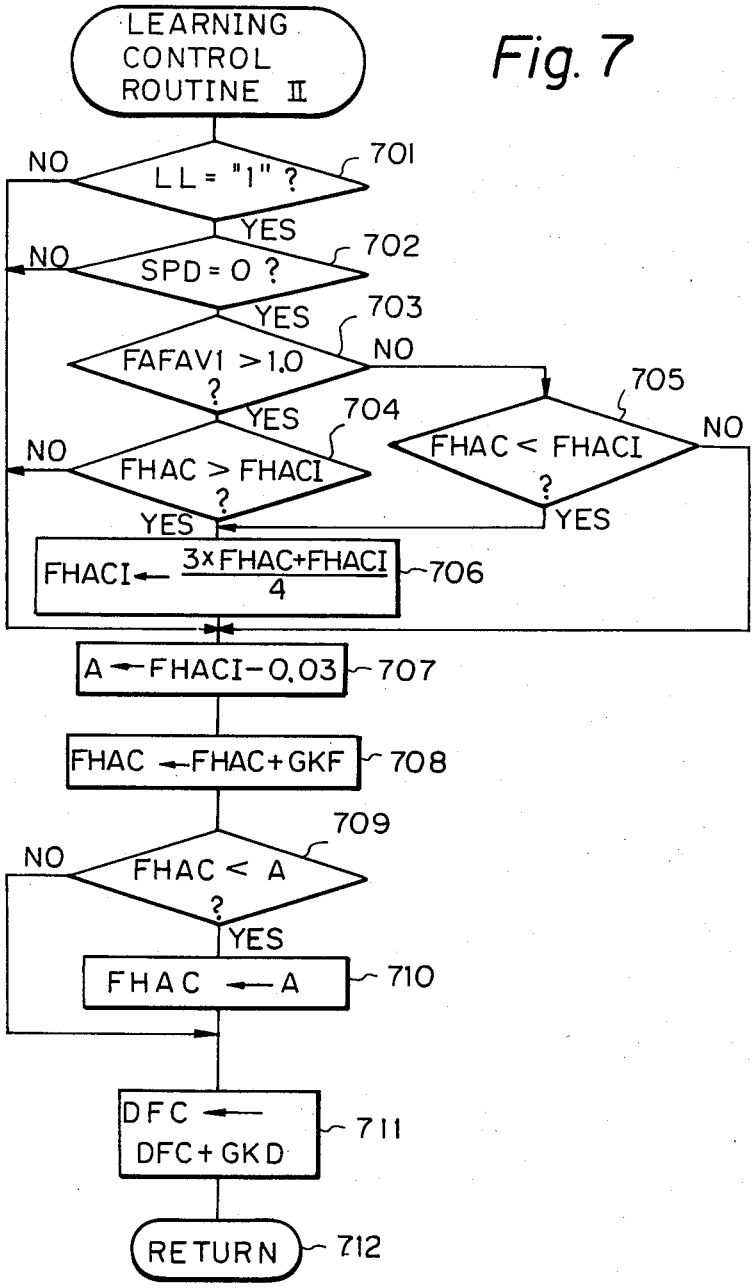

The learning coefficients FHAC and DFC are calculated by the routines of FIGS. 6 and 7.

The learning control routine I of FIG. 6 is executed at steps 404 and 409 of FIG. 4. That is, this routine is executed immediately before a skip operation is performed upon the air-fuel ratio correction coefficient FAF. At step 601, a mean value FAFAV1 is calculated by $$FAFAV1 \leftarrow (FAF+FAF0)/2$$

where FAF0 is the value of the coefficient FAF immediately before the previous skip operation is performed upon the air-fuel ratio correction coefficient FAF. At step 602, it is determined whether or not FAFAV1>1.0 is satisfied. Note that the value 1.0 is the same as the value of the air-fuel ratio coefficient FAF in an open loop (see step 413 of FIG. 4).

If FAFAV1>1.0, this means that the base air-fuel ratio before the execution of the previous skip operation is too lean. Then, at step 603,

GKF←0.002

GKD←0.001 where GKF is a learning amount for the driving at a high altitude, and

GKD is a learning amount for the choking. On the other hand, if FAFAV1≧1.0, this means that the base air-fuel ratio before the execution of the previous skip operation is too rich. Then, at step 604,

GKF←−0.002

$GKD \leftarrow -0.001$

At step 604, it is determined whether or not all the learning control conditions are satisfied. One of the learning control conditions is that the coolant temperature THW is higher than 80° C.

Of course, other learning control conditions are introduced as occasion demands. However, an explanation of such other learning control conditions is omitted.

If one of the learning control conditions is not satisfied, the control jumps to step 607 which clears a skip counter CSK for counting up the number of skip operations. Conversely, if all the learning control conditions are satisfied, the control proceeds to step 605 which determines whether or not $CSK \geqq 5$ is satisfied. Only if $CSK \geqq 5$, does the control proceed to step 606 which carries out another learning control routine as shown in FIG. 7, which will be later explained, then proceeds via step 607 to step 608 which increments the skip counter CSK by 1.

Also, if the determination at step 605 is negative, the control jumps to step 608.

At step 609, in order to prepare the next execution, $FAFO \leftarrow FAF.$

This routine of FIG. 6 is then completed by step 610.

The learning control routine II at step 606 of FIG. 6 will be explained with reference to FIG. 7.

At steps 701 and 702, it is determined whether or not the engine is in an idling state. That is, at step 701, it is determined whether or not LL="1", i.e., the throttle valve 4 is completely closed, and at step 701, it is determined whether or not the vehicle speed SPD=0. Only if the engine is in an idling state (LL="1" and SPD=0), does the control proceed to step 703. Otherwise, the control jumps to step 707.

At step 703, it is determined whether or not $FAFAV1 > 1.0$ is satisfied. If $FAFAV1 > 1.0$, the control proceeds to step 704 which determines whether or not $FHAC > FHACI$ where FHACI is a guard reference value for a lower limit MIN which is imposed on the learning correction coefficient FHAC. The relationship between the guard reference value FHACI and the lower limit MIN is $MIN = FHACI - 0.03$. Also, the guard refence value FHACI can be used as an upper limit MAX which is, for example, equal to $FHACI + 0.01$.

If $FHAC > FHACI$ at step 704, the control proceeds to step 706 which renews the guard reference value FHACI by $$FHACI \leftarrow \frac{3 \times FHAC + FHACI}{4}.$$

Otherwise, the control jumps to step 707.

On the other hand, if $FAFAV1 \leqq 1.0$ at step 703, the control proceeds to step 705 which determines whether or not $FHAC < FHACI$ is satisfied. If $FHAC < FHACI$, the control proceeds to step 706 which renews the guard reference value FHACI. If $FHAC \geqq FHACI$, the control jumps to step 707.

Note that step 705 can be deleted. In this case, if the determination at step 703 is negative, the control proceeds to step 706.

At step 707, the lower limit MIN is calculated by $FHAC - 0.03$ and is stored in the A register.

At step 708, the learning correction coefficient FHAC is renewed by $FHAC \leftarrow FHAC + GKF.$ Note that, if $FAFAV1 > 1.0$, the coefficient FHAC is increased, since $GKF = 0.002$, and if $FAFAV1 \geqq 1.0$, the coefficient FHAC is decreased, since $GKF = -0.002$.

At steps 709 and 710, the coefficient FHAC is guarded by the lower limit MIN (=A). That is, at step 709, it is determined whether or not $FHAC < A$ is satisfied. Only if $FHAC < A$, does the control proceed to step 710 in which $FHAC \leftarrow A$.

At step 711, the learning correction coefficient DFC is renewed by $DFC \leftarrow DFC + GKD.$ Note that, if $FAFAV1 > 1.0$ the coefficient DFC is increased, since $GKD = 0.001$, and if $FAFAV1 \leqq 1.0$, the coefficient FHAC is decreased, since $GKD = -0.001$.

The routine of FIG. 7 is completed by step 712.

Figure 8:
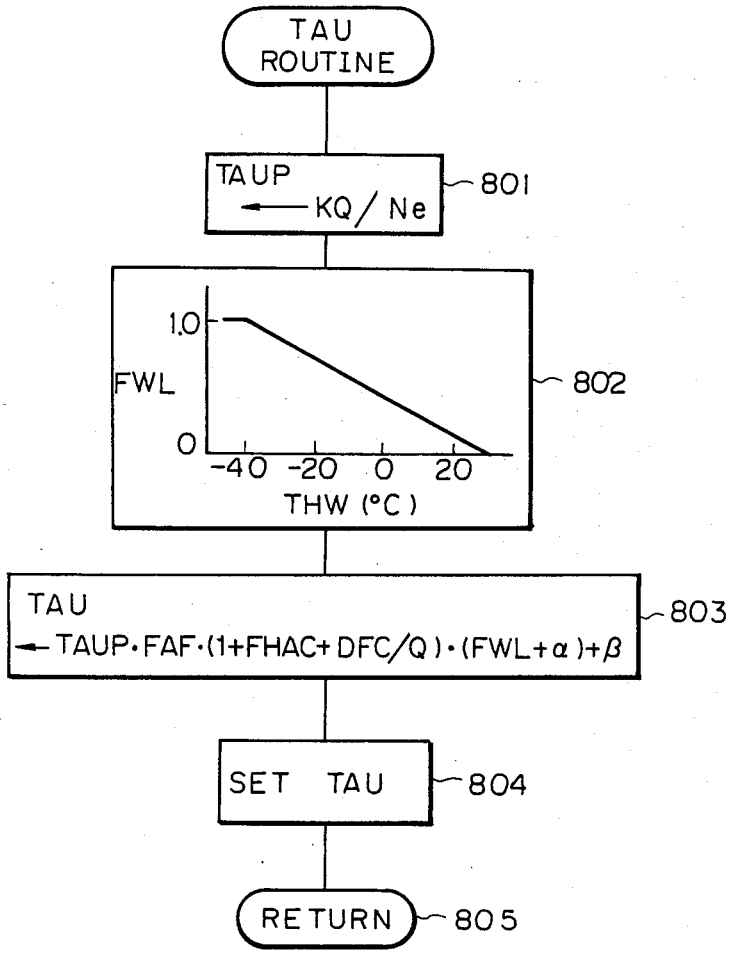

FIG. 8 is a routine for calculating a fuel injection amount TAU executed at every predetermined crank angle such as 360° CA. At step 801, a base fuel injection amount TAUP is calculated by using the intake air amount data Q and the engine speed data Ne stored in the RAM 105. That is, $TAUP \leftarrow KQ/Ne$ where K is a constant. Then at step 802, a warming-up incremental amount FWL is calculated from a one-dimensional map by using the coolant temperature data THW stored in the RAM 105. Note that the warming-up incremental amount FWL decreases when the coolant temperature increases. At step 803, a final fuel injection amount TAU is calculated by $$TAU \leftarrow TAUP \cdot FAF \cdot (1 + FHAC + DFC/Q) \cdot (FWL + \alpha) + \beta$$

where $\alpha$ and $\beta$ are correction factors determined by other parameters such as the voltage of the battery and the temperature of the intake air. At step 804, the final fuel injection amount TAU is set in the down counter 108, and in addition, the flip-flop 109 is set to initiate the activation of the fuel injection valve 14. Then, this routine is completed by step 805. Note that, as explained above, when a time period corresponding to the amount TAU passes, the flip-flop 109 is reset by the carry-out signal of the down counter 108 to stop the activation of the fuel injection valve 14.

As explained above, the lower limit MIN of the learning correction coefficient FHAC is determined by the routine of FIG. 7. For example, in an idling state after the injection of evaporated fuel from the canister 6, the flow at step 703 proceeds via step 704 to step 707. That is, in this case, no renewal of the guard reference value FHACI is carried out. As a result, the learning correction coefficient FHAC is little decreased by the vaporized fuel. In addition, the learning correction coefficient FHAC returns rapidly to a normal value by the learning control. Therefore, it is possible to lessen the affect of vaporized fuel against the compensation for a high altitude. On the other hand, in an idling state when moving from a low altitude to a high altitude, the flow at step 703 proceeds via step 705 to step 706 which renews the guard reference value FHACI. In this case, the guard reference value FHACI is decreased. Therefore, the learning correction coefficient FHAC can be further decreased to compensate for the driving at a high altitude. Contrary to this, in an idling state when moving from a high altitude to a low altitude, the flow at step 703 proceeds via step 704 to step 706 which renews the guard reference value FHACI. In this case, the guard reference value FHACI is increased. Therefore, the learning correction coefficient FHAC can be further increased to compensate for the driving at a low altitude.

Further, the renewal of the guard reference value FHAC is carried out, when FHAC>FHACI if the base air-fuel ratio is lean (FAFAV>1.0), or when FHAC≦FHACI if the base-fuel ratio is rich (FAFAV≦1.0). Therefore, even in a special driving state such as in the case of the generation of vaporized fuel during the LA4 mode, the lower limit of the learning correction coefficient FHAC is defined by the guard reference value FHACI, and accordingly, the learning correction coefficient FHAC can be correctly renewed.

The learning correction coefficient FHAC will be explained in more detail with reference to FIGS. 9A through 9E. It is considered that the output LL of the idling switch 5 is changed as shown in FIG. 9A. First, if the guard reference value FHACI is always renewed when the engine is in an idling state (LL="1"), the guard referene value FHACI is not renewed from $t_1$ to time $t_2$ as shown in FIG. 9B, but the learning correction coefficient FHAC is decreased by the vaporized fuel from time $t_1$ to time $t_2$ as shown in FIG. 9C, since the base air-fuel ratio becomes rich (FAFAV≧1.0). In this case, the learning correction coefficient FHAC is guarded by the lower limit, i.e., 0.97 (=FHACI−0.03). During a time period from time $t_2$ to time $t_3$, the throttle valve 4 is completely closed, thereby stopping the generation of vaporized fuel. Therefore, since the learning correction coefficient FHAC remains at the lower limit (=0.97), the base air-fuel ratio becomes rich (FAFAV1>1.0), so as to increase the learning correction coefficient FHAC by the learning control. Simultaneously, the guard reference value FHACI is decreased in accordance with the learning correction coefficient FHAC. When the learning correction coefficient FHAC approaches the guard reference value FHACI, the latter again increases. However, at time $t_3$ before the guard reference value FHACI reaches 1.0, the output LL of the idling switch 4 becomes "0" so that the guard reference value FHACI remains at 0.99. Therefore, in this case, during a time period from time $t_3$ to time $t_4$, the lower limit is 0.96. If such a driving state is repeated, it is clear that the guard reference value FHACI is further decreased, and accordingly, the lower limit is further decreased. As a result, the learning correction coefficient FHAC becomes too small because of the affect of the vaporized fuel, which makes it difficult to compensate for the driving at a high altitude.

Contrary to the above, due to the presence of steps 703 and 704, even during a time period from time $t_2$ to time $t_3$, the guard reference value FHACI is never renewed as shown in FIG. 9D, and accordingly, the lower limit of the learning correction coefficient FHAC still remains at 0.97 as shown in FIG. 9E. Therefore, even when such a driving state is repeated, the lower limit does not become very small, which ensures compensation for the driving at a high altitude.

Figures 10, 10A:
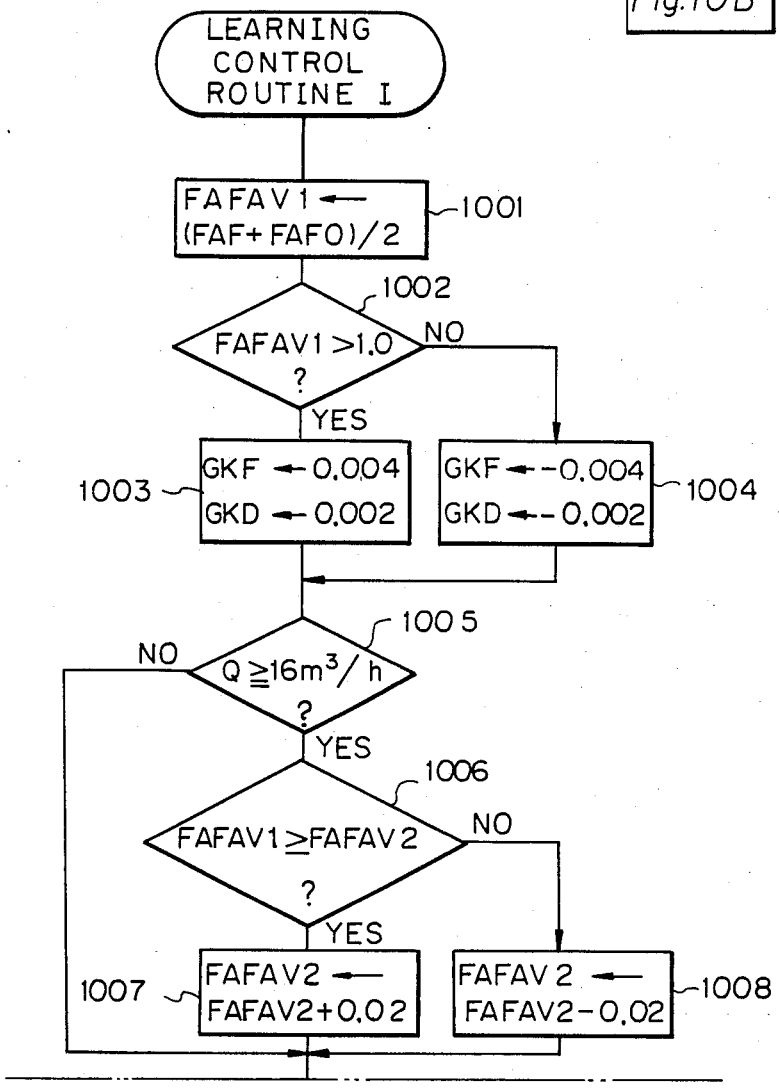
Figure 10B:
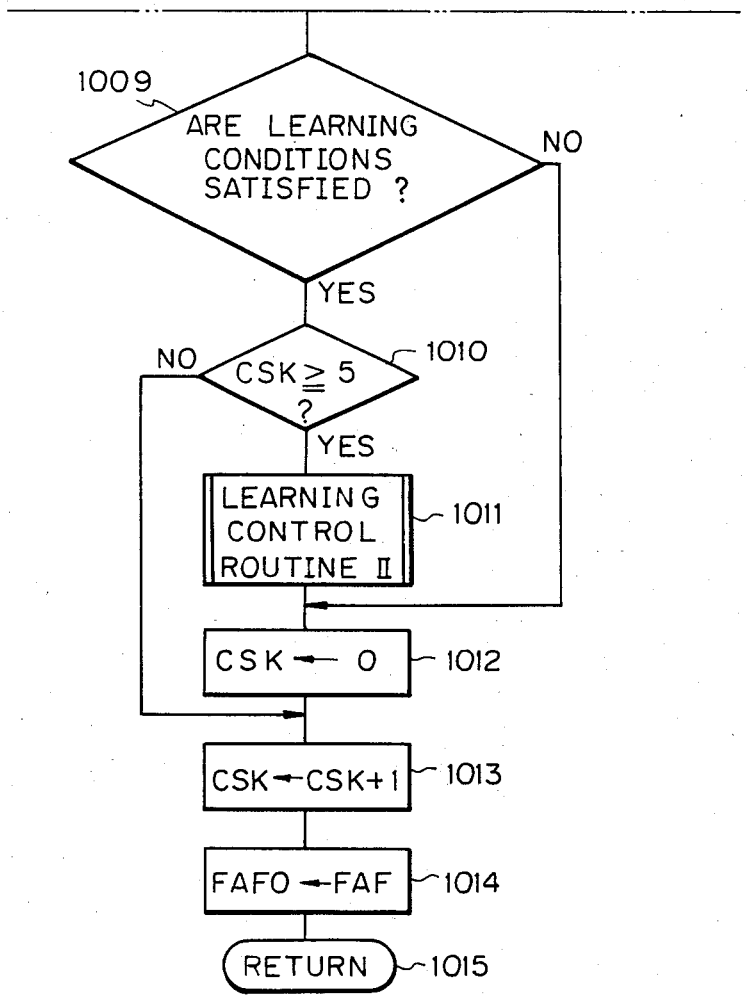
Figures 11, 11A, 11B, 11C, 11D:
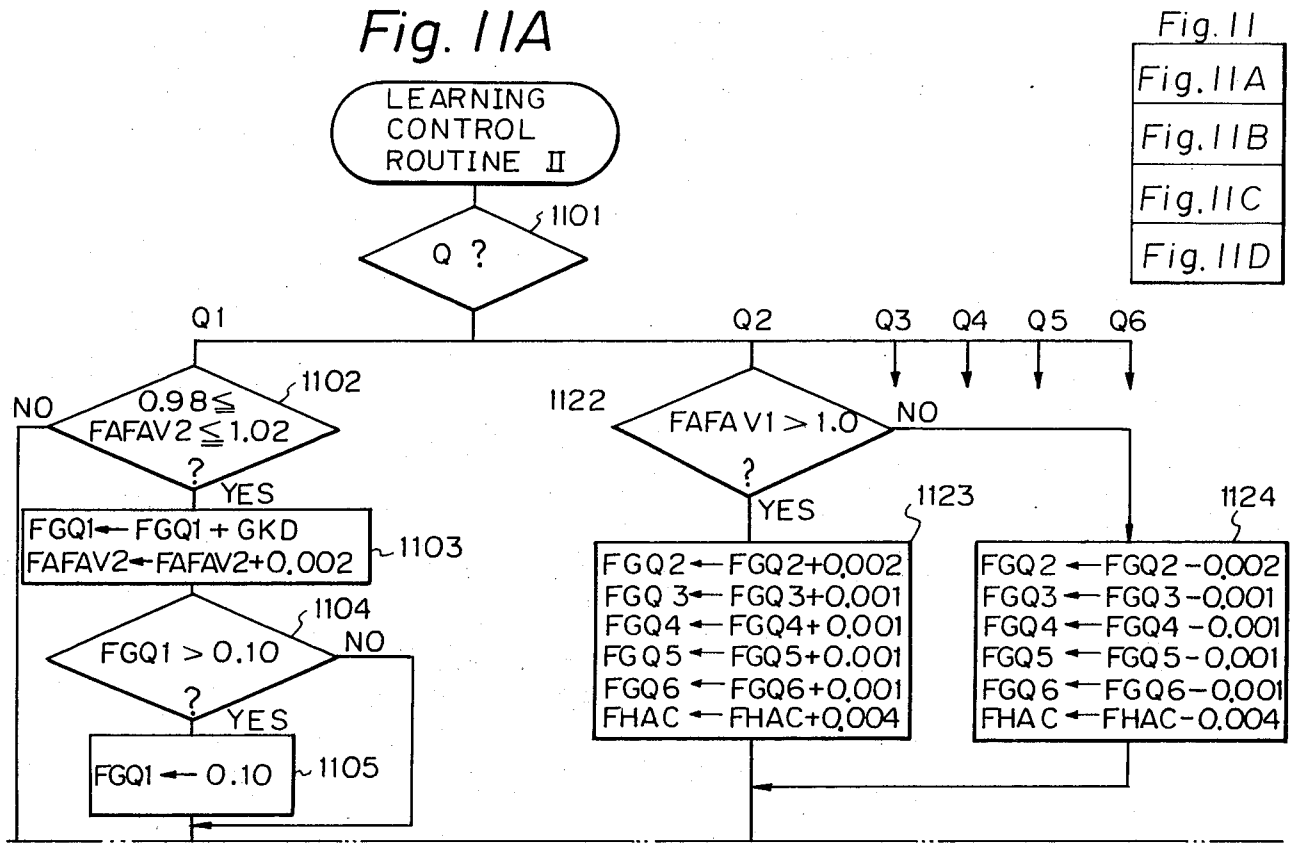
Figure 11B:
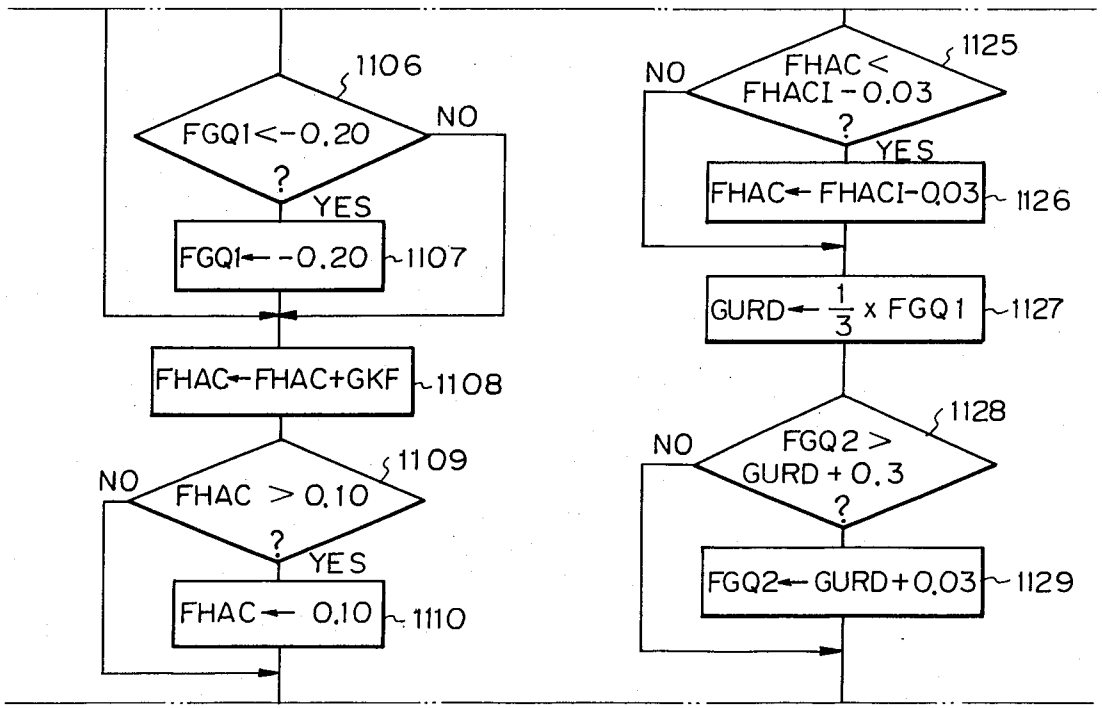
Figure 11C:
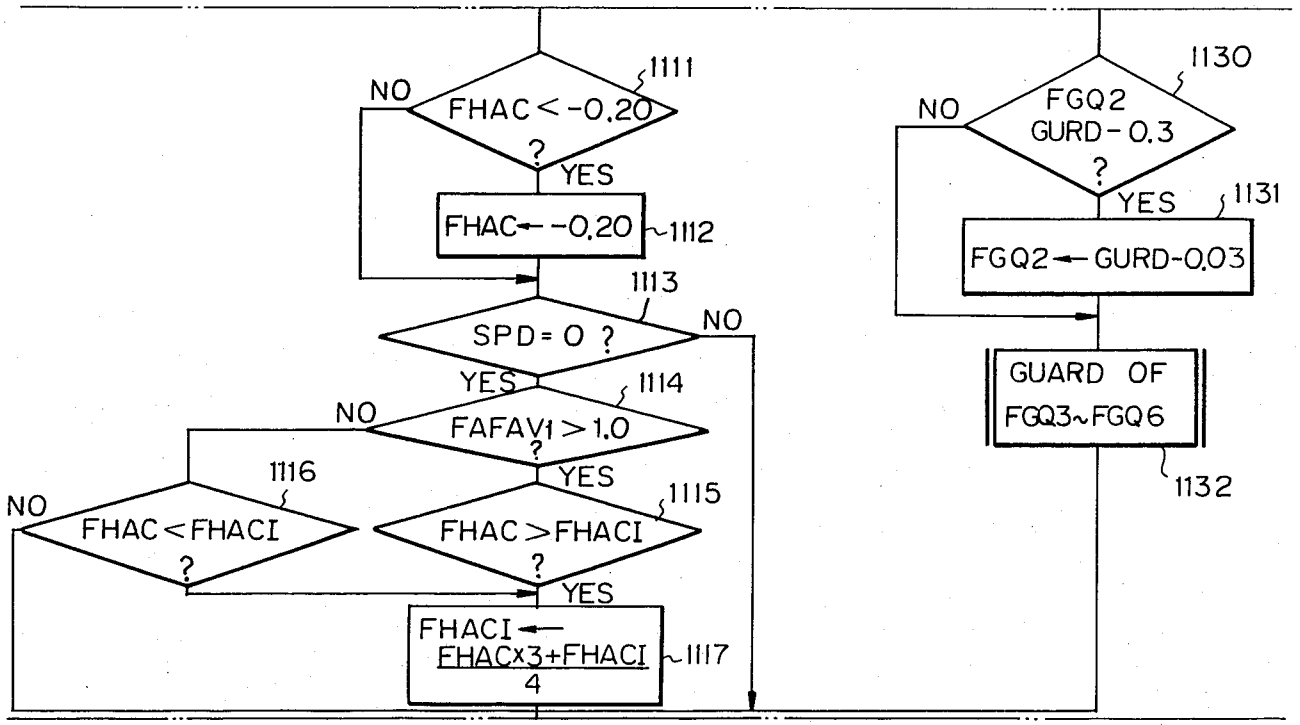
Figure 11D:
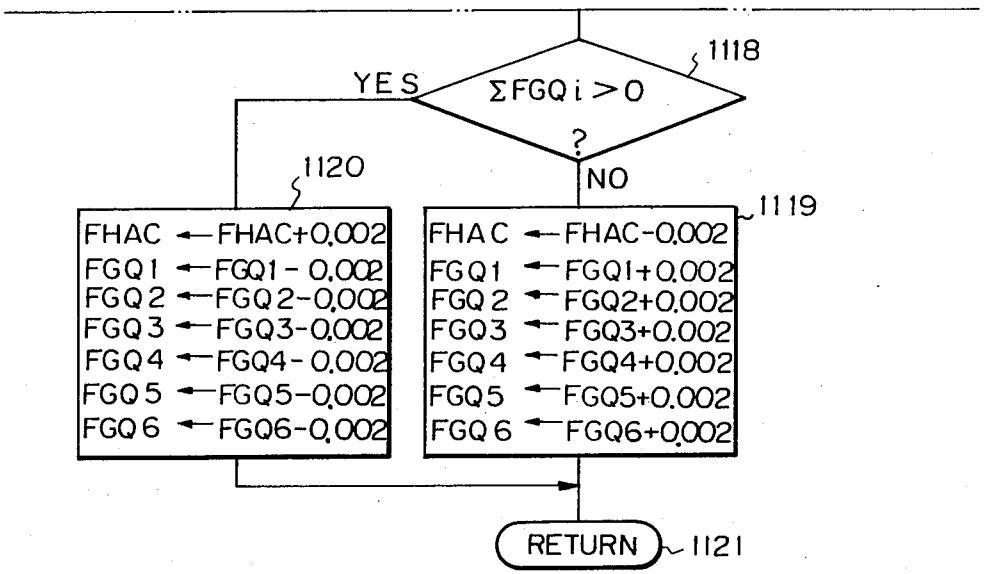
Figure 12:
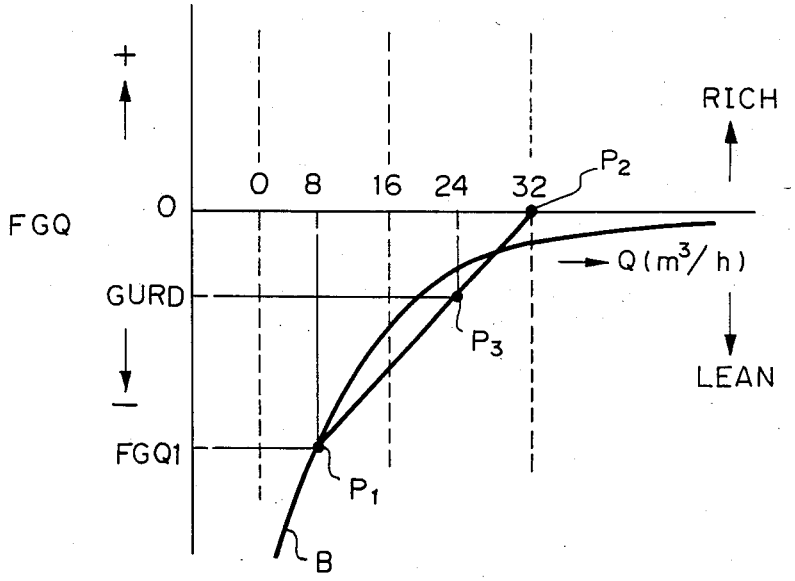
FIG. 12 is a graph showing the characteristics of the coefficient FGQ of FIG. 12.
Figure 13:
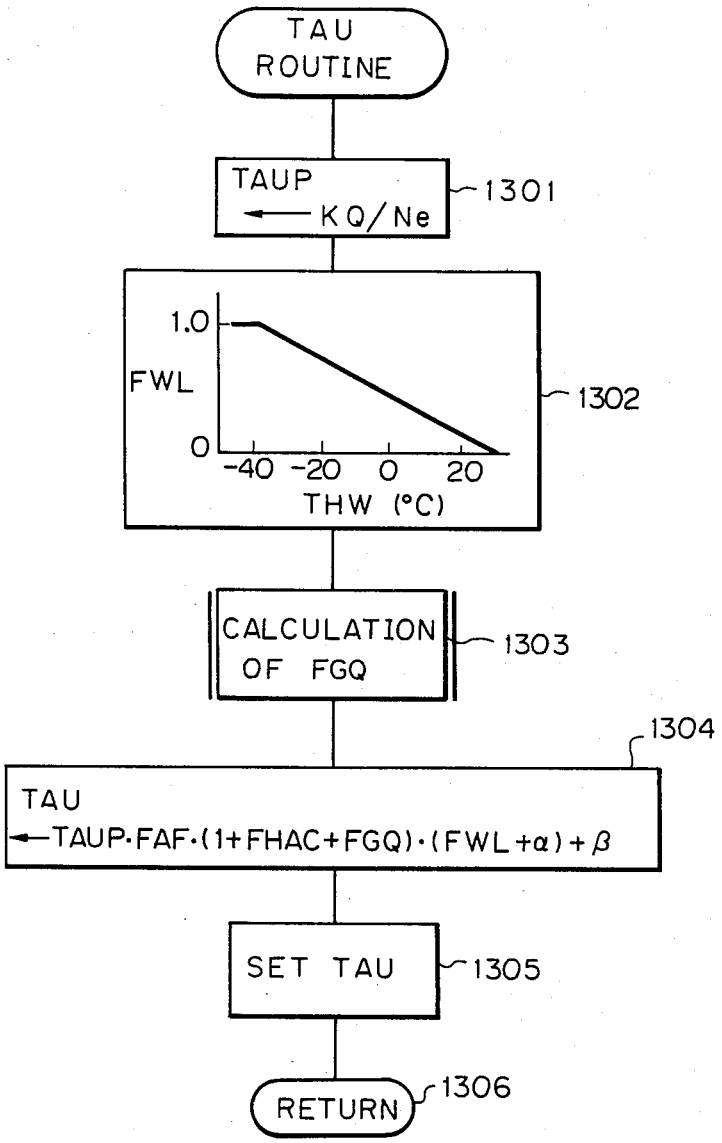

FIG. 10 is a modification of the routine of FIG. 6, FIG. 11 is a modification of the routine of FIG. 7, and FIG. 12 is a modification of FIG. 13.

According to another aspect of the present invention, a learning correction coefficient FG is defined by $$FG=1+FHAC+FGQ$$

where FHAC is a learning correction coefficient for compensating for the driving at a high altitude, and FGQ is a learning correction coefficient for compensating for the choking of the airflow meter allocated for every flow rate region.

The learning coefficients FHAC and FGQ are calculated by the routines of FIGS. 10 and 11.

The learning control routine I of FIG. 10 is also executed at steps 404 and 409 of FIG. 4. Steps 1001 through 1004 correspond to steps 601 through 604, respectively. However, at step 1003,

GKF←0.004

GKD←0.002, while at step 1004

GKF←−0.004

GKD←−0.002.

At step 1005, it is determined whether or not Q≧16 $m^3/h$ is satisfied. In this case, there are prepared six regions, as follows:

| | Q1 | Q2 | Q3 | Q4 | Q5 | Q6 |
|---|---|---|---|---|---|---|
| Q ($m^3/h$) | 0~16 | 16~32 | 32~48 | 48~64 | 64~80 | 80~ |

Note that learning correction coefficients FGQ1 through Q6 for compensating for the choking of the airflow meter are allocated to the regions Q1 through Q6, respectively. Therefore, step 1005 determines whether or not the current intake air amount Q stored in the RAM 105 belongs to the regions Q2 through Q6. If the intake air amount Q belongs to the regions Q2 through Q6, the control proceeds to step 1006, while if the intake air amount Q belongs to the region Q1, the control jumps to step 1009.

At step 1006, it is determined whether or not FAFAV1≧FAFAV2 is satisfied. Note that FAFAV2 designates a learning correction determination value for compensating for the choking of the airflow meter, and this value FAFAV2 is caused to be 1.0 by the initial routine.

If FAFAV1≧FAFAV2, the control proceeds to step 1007 which increments FAFAV2 by 0.02, while if FAFAV1<FAFAV2, the control proceeds to step 1008 which decrements FAFAV2 by 0.02.

Steps 1009 through 1015 correspond to steps 606 through 610 of FIG. 6, respectively, and accordingly, the explanation thereof is omitted.

The learning control routine at step 1011 of FIG. 10 will be explained with reference FIG. 11. At step 1101, it is determined to what regions Q1 through Q6 the current intake air amount Q stored in the RAM 105 belongs. Note that the region Q1 corresponds to the state where the throttle valve 4 is completely closed.

If the throttle valve 4 is completely closed (LL="1"), the control proceeds to step 1102, since the intake air amount Q is, in this case, less than 16 $m^2/h$. At step 1102, it is determined whether or not $0.98 \leqq FAFAV2 \leqq 1.02$ is satisfied. If $0.98 \leqq FAFAV2 \leqq 1.02$, the control proceeds to steps 1103 through 1107. Otherwise, the control jumps to step 1108.

At step 1103, the learning correction coefficient FGQ1 is incremented by GKD obtained at step 1003 or 1004 of FIG. 10, and in addition, the determination value FAFAV2 is incremented by 0.002. Then at steps 1104 and 1105, the learning correction coefficient FGQ1 is guarded by the maximum value such as 0.10, at steps 1106 and 1107, the learning correction coefficient FGQ1 is guarded by the minimum value such as −0.20.

At step 1108, the learning correction coefficient FHAC is incremented by GKF obtained at step 1103 or 1004 of FIG. 10. Then at steps 1109 and 1110, the learning correction coefficient FHAC is guarded by the maximum value such as 0.10, at steps 1111 and 1112, the learning correction coefficient FHAC is guarded by the minimum value such as −0.20.

Steps 1113 through 1117 correspond to steps 702 through 706 of FIG. 7, respectively, and accordingly, the explanation thereof is omitted.

At step 1118, it is determined whether or not the sum $\Sigma FGQi(=FGQ1+FGQ2+\ldots+FGQ6)$ is positive or negative. If the sum is negative, this means the movement from a low altitude to a high altitude. Therefore, the control proceeds to step 1119 which decrements FHAC by 0.002 and increments FGQ1 through FGQ6 by 0.002. If the sum is positive, this means the movement from a high altitude to a low altitude. Therefore, the control proceeds to step 1120 which increments FGAC by 0.002 and decrements FGQ1 through FGQ6 by 0.002.

Thus, the routine of FIG. 11 is completed by step 1121.

If the current intake air amount Q is determined to belong to the region Q2, the control proceeds to step 1122 which determines whether or not FAFAV1>1.0 is satisfied. If FAFAV1>1.0, at step 1123,

FGQ2←FGQ2+0.002

FGQ3←FGQ3+0.001

FGQ4←FGQ4+0.001

FGQ5←FGQ5+0.001

FGQ6←FGQ6+0.001

FHAC←FHAC+0.004.

Contrary to this, if FAFAV1≦1.0, at step 1124,

FGQ2←FGQ2−0.002

FGQ3←FGQ3−0.001

FGQ4←FGQ4−0.001

FGQ5←FGQ5−0.001

FGQ6←FGQ6−0.001

FHAC←FHAC−0.004.

At steps 1125 and 1126, the learning coefficient FHAC is guarded by the minimum value which equals (FHACI−0.03).

At step 1127, a guard value GURD of the learning correction is calculated by

GURD←⅓×FGQ1.

That is, as shown in FIG. 12, position $P_1$ designates the value of the learning correction coefficient FGQ1 at Q=8 $m^3/h$ which corresponds to an idling state, and $P_2$ designates the value of the learning correction coefficient FGQ1 at Q=32 $m^3/h$. In this case, the guard value GURD is defined by position $P_3$ on the line linked between positions $P_1$ and $P_2$ at Q=24 $m^3/h$. Thus, the learning correction coefficient FGQ2 is guarded, thereby obtaining the coefficient FGQ2 suitable for the choking characteristics of the airflow meter. Note that when the airflow meter is choked due to aging, the air-fuel ratio is affected more strongly at a small intake air amount Q by the choking, as indicated by B.

At steps 1128 and 1129, the learning correction coefficient FGQ2 is guarded by the maximum value, i.e., GURD+0.3, and at steps 1130 and 1131, the learning correction coefficient FGQ2 is guarded by the minimum value, i.e., GURD−0.3.

At step 1132, other learning correction coefficients FGQ3 through FGQ6 are guarded by the maximum value which is, for example, 0.3, and are also guarded by the minimum value which is, for example, −0.3. Then, the control proceeds to step 1118.

At step 1101, the current intake air amount Q is determined to belong to the region Q3, Q4, Q5, or Q6, and the same process as shown in steps 1122 through 1132 is also carried out. Note that, at steps corresponding to steps 1123 and 1124, a relative large amount is added to or subtracted from the learning correction coefficient belong to the corresponding region.

The above-obtained learning correction coefficients FGQ1 through FGQ6 are used as the learning correction coefficient FGQ at the center value of each of the regions Q1 through Q6. For example, the value of the coefficient FGQ at Q=8 $m^3/h$ is FGQ1; the value of the coefficient FGQ at Q=24 $m^3/h$ is FGQ2; the value of the coefficient FGQ at Q=40 $m^3/h$ is FGQ3; . . . ; the value of the coefficient FGQ at Q=96 $m^3/h$ is FGQ6.

In FIG. 13, steps 1301, 1302, 1305, and 1306 correspond to steps 801, 802, 804, and 805 of FIG. 8, respectively, and steps 1303 and 1304 correspond to step 803 of FIG. 8. That is, at step 1303, the learning correction coefficient FGQ is calculated from FGQ1 (Q=8 $m^3/h$), FGQ2 (Q=24 $m^3/h$), . . . , FGQ6 (Q=86 $m^3/h$) by the interpolation method based upon the parameter Q. Then at step 1304, a final fuel injection amount TAU is calculated by $$TAU \leftarrow TAU \cdot FAF \cdot (1+FHAC+FGQ) \cdot (FWL+\alpha)+\beta$$

Thus, according to the modifications of FIGS. 10, 11, and 13, when the learning correction coefficient FGC=1+FHAC+FGQ) is calculated, it is determined to what region the current intake air amount Q belongs. If the current intake air amount Q is determined to belong to the regions other than the region Q1 which corresponds to LL="1", all the learning correction coefficients FGQ1 through FGQ6 are simultaneously controlled. Therefore, even after driving from a low altitude to a high altitude at a definite intake air amount such as a large intake air amount, the drivability at a middle intake air amount is also improved.

In addition, if the mean value FAFAV1 of the air-fuel ratio correction coefficient FAF is larger than a definite value, the coefficients FHAC and the coefficients FGQ1 through FGQ6 allocated to the regions Q1 through Q6 are increased, while if the mean value FAFAV1 of the air-fuel ratio correction coefficient FAF is not larger than a definite value, the coefficients FHAC and the coefficients FGQ1 through FGQ6 are decreased. Further, if all the coefficients FGQ1 through FGQ6 are negative, the coefficient FHAC is decreased while the coefficients FGQ1 through FGQ6 are increased, if all the coefficients FGQ1 through FGQ6 are positive, the coefficient FHAC is increased while the coefficients FGQ1 through FGQ6 are decreased. This is helpful in absorbing the variation of the air-fuel ratio between the regions. Further, the coefficients FGQ1 through FGQ6 can be controlled within a narrow range so as to effectively compensate for the driving at a high altitude.

Also, the coefficients FGQ2 through FGQ6 are guarded as shown in FIG. 12 so as to conform to the choking characteristics of the airflow meter, thereby carrying out the control of the air-fuel ratio suitable for the choking of the airflow meter.

We claim:

1. A method for controlling the air-fuel ratio in an internal combustion engine comprising the steps of:

calculating a base fuel amount in accordance with predetermined parameters of said engine;

detecting an air-fuel ratio of said engine;

calculating an air-fuel ratio correction amount in accordance with the detected air-fuel ratio so that the air-fuel ratio of said engine is brought close to a predetermined air-fuel ratio;

calculating a mean value of said air-fuel ratio correction amount;

calculating a learning correction amount so that the mean value of said air-fuel correction amount is brought close to a predetermined value;

setting a lower limit upon said learning correction amount;

determining whether or not said engine is in an idling state;

determining whether or not the mean value of said air-fuel ratio correction amount is larger than the predetermined value, when said engine is in an idling state;

determining whether or not said learning correction amount is larger than a lower limit reference value for said lower limit, when said engine is in an idling state;

renewing said lower limit reference value in accordance with said learning correction amount, when the mean value of said air-fuel ratio correction amount is larger than the predetermined value and said learning correction amount is larger than said lower limit reference value; and adjusting the actual air-fuel ratio in accordance with said base fuel amount, said air-fuel ratio correction amount, and said learning correction amount.

2. A method as set forth in claim 1, further comprising a step of renewing said lower limit reference value in accordance with said learning correction amount, when the mean value of said air-fuel amount is not larger than the predetermined value and said learning correction amount is smaller than said lower limit reference value.

3. A method as set forth in claim 1, wherein said air-fuel correction amount calculating step comprises the steps of:

gradually decreasing said air-fuel ratio correction amount when the detected air-fuel ratio is on the rich side;

gradually increasing said air-fuel ratio correction amount when the detected air-fuel ratio is on the lean side;

remarkably decreasing said air-fuel ratio correction amount when the detected air-fuel ratio is switched from the lean side to the rich side; and remarkably increasing said air-fuel ratio correction amount when the detected air-fuel ratio is switched from the rich side to the lean side.

4. A method as set forth in claim 3, wherein said mean value calculating step comprises a step of calculating a mean value of two sequential air-fuel ratio correction amounts immediately before the switching of the detected air-fuel ratio.

5. A method as set forth in claim 1, wherein said learning correction amount calculating step comprises the steps of:

increasing said learning correction amount when the mean value of said air-fuel correction amount is larger than the predetermined value; and decreasing said learning correction amount when the mean value of said air-fuel correction amount is not larger than the predetermined value.

6. An apparatus for controlling the air-fuel ratio in an internal combustion engine comprising:

means for calculating a base fuel amount in accordance with predetermined parameters of said engine;

means for detecting an air-fuel ratio of said engine;

means for calculating an air-fuel ratio correction amount in accordance with the detected air-fuel ratio so that the air-fuel ratio of said engine is brought close to a predetermined air-fuel ratio;

means for calculating a mean value of said air-fuel ratio correction amount;

means for calculating a learning correction amount so that the mean value of said air-fuel correction amount is brought close to a predetermined value;

means for setting a lower limit upon said learning correction amount;

means for determining whether or not said engine is in an idling state;

means for determining whether or not the mean value of said air-fuel ratio correction amount is larger than the predetermined value, when said engine is in an idling state;

means for determining whether or not said learning correction amount is larger than a lower limit reference value for said lower limit, when said engine is in an idling state;

means for renewing said lower limit reference value in accordance with said learning correction amount, when the mean value of said air-fuel ratio correction amount is larger than the predetermined value and said learning correction amount is larger than said lower limit reference value; and means for adjusting the actual air-fuel ratio in accordance with said base fuel amount, said air-fuel ratio correction amount, and said learning correction amount.

7. An apparatus as set forth in claim 6, further comprising means for renewing said lower limit reference value in accordance with said learning correction amount, when the mean value of said air-fuel amount is not larger than the predetermined value and said learning correction amount is smaller than said lower limit reference value.

8. An apparatus as set forth in claim 6, wherein said air-fuel correction amount calculating means comprises:

means for gradually decreasing said air-fuel ratio correction amount when the detected air-fuel ratio is on the rich side;

means for gradually increasing said air-fuel ratio correction amount when the detected air-fuel ratio is on the lean side;

means for remarkably decreasing said air-fuel ratio correction amount when the detected air-fuel ratio is switched from the lean side to the rich side; and means for remarkably increasing said air-fuel ratio correction amount when the detected air-fuel ratio is switched from the rich side to the lean side.

9. An apparatus as set forth in claim 8, wherein said mean value calculating means calculates a mean value of two sequential air-fuel ratio correction amounts immediately before the switching of the detected air-fuel ratio.

10. An apparatus as set forth in claim 6, wherein said learning correction amount calculating means comprises:

means for increasing said learning correction amount when the mean value of said air-fuel correction amount is larger than the predetermined value; and means for decreasing said learning correction amount when the mean value of said air-fuel correction amount is not larger than the predetermined value.

* * * * *